US006327296B1

(12) United States Patent
Poloni et al.

(10) Patent No.: US 6,327,296 B1
(45) Date of Patent: Dec. 4, 2001

(54) COOLED ROOF FOR ELECTRIC ARC FURNACES AND LADLE FURNACES

(75) Inventors: Alfredo Poloni, Fogliano di Redipuglia; Milorad Pavlicevic, Udine; Gianni Gensini, Buia, all of (IT); Peter Tishchenko, Donezk (UA); Angelico Della Negra, Povoletto (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/601,574

(22) PCT Filed: Feb. 8, 1999

(86) PCT No.: PCT/IB99/00221

§ 371 Date: Aug. 4, 2000

§ 102(e) Date: Aug. 4, 2000

(87) PCT Pub. No.: WO99/41560

PCT Pub. Date: Aug. 19, 1999

(30) Foreign Application Priority Data

Feb. 11, 1999 (IT) ..... UD98A0018

(51) Int. Cl.[7] ..... F27D 1/02
(52) U.S. Cl. ..... 373/74; 373/73; 373/75
(58) Field of Search ..... 373/71, 72, 73, 373/74, 75, 76, 77

(56) References Cited

U.S. PATENT DOCUMENTS 5,241,559 8/1993 Hixenbaugh ..... 373/74

FOREIGN PATENT DOCUMENTS 2830720 1/1980 (DE) .
2912004 10/1980 (DE) .
4209765 9/1993 (DE) .
2110802 6/1983 (GB) .

*Primary Examiner*—Tu Ba Hoang
(74) *Attorney, Agent, or Firm*—Stevens, Davis, Miller & Mosher, LLP

(57) ABSTRACT

A cooled roof for electric arc furnaces (20) or ladle furnaces (29). The roof being used as a covering element and including a cooling system comprising tubes fed with cooling fluid. The roof including at least a central aperture (25) for the positioning and movement of the electrodes (30) and at least a peripheral aperture (14) for the aspiration and discharge of fumes. The aperture (14) being connected to intake systems. The roof including two single-block cooling structures, inner (1) and outer (12), consisting of respective bent tubes (15, 16) developing according to adjacent and superimposed rings or spirals. The inner (11) and outer (12) cooling structures being associated with one another at least in correspondence with the respective bases facing towards the inside of the furnace (20, 29). Between the inner cooling structure (11) and the outer cooling structure (12) there being defined an annular interspace (13) in which the fumes circulate in an annular direction and slow down. The annular interspace (13) communicating with the peripheral aperture. The inner cooling structure (11) including fume-transit interstices connecting the inside of the furnace (20, 29) with the annular interspace (13).

23 Claims, 3 Drawing Sheets

COOLED ROOF FOR ELECTRIC ARC FURNACES AND LADLE FURNACES

FIELD OF THE INVENTION

This invention concerns a cooled roof for electric arc furnaces and ladle furnaces.

The invention is applied in the field of steel production as a removable covering element in electric arc furnaces and in ladle furnaces employed to melt and process ferrous and non-ferrous metallic alloys.

BACKGROUND OF THE INVENTION

The state of the art includes roofs employed as a removable covering element in electric arc furnaces and in ladle furnaces so as to prevent the dispersion of heat from inside the furnace and the leakage of noxious fumes and volatile waste.

These roofs normally include at least a central aperture for the electrodes and a peripheral aperture, or fourth hole, connected to an intake system, to discharge the fumes and the volatile particles of waste and powders from inside the melting volume.

To avoid an excessive heating of the roof, and to remove the heat generated during the melting cycles, the roofs are equipped with a cooling system consisting of a plurality of cooling conduits, usually closely adjacent to each other, fed with cooling fluid under pressure and having a radial development, or circular with rings, or helical, or coiled or some other form and achieving heat exchange surfaces which may be vertical, horizontal or sloping.

One problem in the embodiment of such cooling systems is that the temperatures are distributed in a non-homogeneous manner over the surface of the roof.

In fact, it is well known that the heat in the central part of the roof, where the electrodes are, is greater than that in the peripheral part due to the heat irradiance caused by the electrodes themselves. Moreover, the temperature near the aperture through which the fumes are discharged is greater than that on the opposite side because of the greater flow of hot fumes towards this aperture.

In point of fact, the discharge aperture is associated with aspiration systems which create a non-uniform depression inside the furnace.

This aspiration creates a preferential flow of fumes and especially of the air entering the melting volume through the technological apertures (slag door, apertures for the burners, lances, to introduce additives, etc.) and also through the imperfect seals on the mechanical connections, generating a lack of thermal homogeneity inside the melting volume.

To be more exact, the imperfect sealing of the roof and the side wall of the furnace, together with the negative pressure which is created in the zone below the roof due to the aspiration caused by the fume discharge systems, causes an influx of atmospheric air which comes into contact with the electrodes.

Because of this phenomenon, there is an extremely high consumption of the graphite of which the electrodes consist, due to the fact that the oxygen contained in the air, as it laps the extremely hot lateral surface, causes the graphite to oxidise.

A further technological shortcoming is that the air, as it passes through the area occupied by the melting volume, causes thermal imbalance, cooling the whole area and not allowing a favourable operation in energy terms.

Finally, especially in ladle furnaces, and especially during the refining step, it is highly desirable, for economic and technological reasons, to obtain a condition whereby the atmosphere above the melting volume is controlled in order to obtain, quickly and accurately, a desired composition for the steel to be produced.

These conditions are not achieved in embodiments known to the art, wherein the air which inevitably enters the melting volume through the circular separating interspace between the roof and the shell of the furnace—since it is impossible to seal the melting volume permanently and perfectly—comes into direct contact with the atmosphere created inside the melting volume.

The influx of atmospheric air into the melting volume causes an oxidation effect on the slag and the liquid metal, which in turn leads to a worsening in the quality of liquid metal produced.

The non-homogeneous depression which is thus created inside the furnace, moreover, causes a high consumption—or even the removal—of binding materials, technological materials and slag-forming materials which are carried away in the main flow.

It is therefore necessary to reduce this removal, with the aim of recovering the technological powders and materials, by causing the fumes to flow at limited speeds, and therefore reducing the capacity which the fumes have of carrying away the fine volatile elements which are suspended in the melting volume.

This is to have an immediate economic advantage deriving from a greater yield of the materials loaded into the furnace.

Another disadvantage of cooled roofs such as are known to the art is that they cause heat to be removed in a substantially uniform manner over the whole of their surface. This means that the removal of heat must be at least equal to that required at the hottest zone of the furnace and therefore, for a large part of the surface of the roof, the cooling system is over-sized, which causes high energy consumption and greater costs of the plant.

There are also roofs in which, in order to extend their working life, the cooling conduits are protected, at least on the side facing the inside of the furnace, by refractory material.

This embodiment, however, has not been very efficacious since the refractory material wears very quickly, and then tends to become detached and to fall inside the furnace, due to the considerable differences in temperature between the inner face of the refractory material facing the electrodes and the outer face of the refractory material which is in contact with the cooling conduits.

There are also roofs consisting of cooling panels, for example with a conformation of contiguously arranged segments. Each panel has a group of cooling conduits associated with an individual cooling system or a common cooling system.

In the first case, the construction and management costs are very high, while in the second case the welds between the individual panels, or even between the individual elements of the cooling conduits, constitute critical points and create tensions along the conduit which cannot be completely eliminated even by heat treatments such as tempering or annealing.

These tensions, due to the conditions of extremely high temperatures to which the tubes are subjected, may lead to the welds breaking, with the resulting leakage of cooling water which will enter the furnace. Given the high pressure of the water which is usually circulating in the cooling conduits, there is a considerable quantity of water which penetrates into the furnace, and as soon as it comes into contact with the molten metal it immediately evaporates; this leads to a sudden increase in pressure which may, in certain conditions, lead to an explosion.

If this phenomenon should occur, the furnace must be switched off immediately, with all the technical and economic problems which that entails, apart from the potential danger for the workers.

There are also roofs equipped with shower-type cooling systems, using jets of water cooperating with the outer surface of the roof.

The advantage of shower-type cooling systems is that it is possible to distribute the jets of water over the surface of the roof as one wants, in such a way as to obtain a greater cooling effect in the hottest zones. On the other hand, however, shower-type cooling systems have the disadvantage that the removal of heat in the peripheral zone of the roof, where the sprayed cooling water is collected, is very high even though in this peripheral zone less heat should be removed than from the hotter, central zone.

In none of the embodiments such as are known to the art has there ever been proposed a solution which makes it possible to act on every area of the cooling system of the roof of the melting volume in such a way as to make the thermal loads uniform, to achieve the desired and appropriate conditions of controlled atmosphere inside the melting volume, to avoid unbalancing the technological operation of melting and refining due to the mixing of air with the fumes from the melting process, and to drastically diminish the consumption of the graphite in the electrodes.

Documents U.S. Pat. No. 4,401,464 and SU-A-1759894 propose solutions which provide to create a zone of depression immediately under the roof to prevent the atmospheric air which enters through the technological apertures from affecting the liquid metal inside the furnace.

These embodiments however do not prevent the influx of atmospheric air from coming into contact with the electrodes, with the resulting problems of premature wear on the electrodes.

Moreover, these embodiments do not achieve efficient operations to separate the powders and to recover and re-use the volatile slag mixed in with the fumes which are discharged from the furnace.

A further problem of embodiments known to the art concerns the wear and deterioration of the mechanical characteristics of the electrode-bearing cover arranged at the center of the roof.

This wear involves greater maintenance costs and long intervention times.

The present Applicant has designed, tested and embodied this invention to overcome the shortcomings of the state of the art and to obtain further advantages as shown hereinafter.

SUMMARY OF THE INVENTION

The main purpose of the invention is to provide a cooled roof for electric arc furnaces or ladle furnaces suitable to create inside the furnace a depression to enable the fumes to be discharged in a substantially homogeneous and uniform manner over the whole volume of the furnace, in such a way as to prevent the atmospheric air which enters inside the melting volume from coming into contact, directly and non-homogeneously, with the atmosphere created in the melting volume itself.

To be more exact, the purpose of the invention is to prevent the atmospheric air, which is sucked into the furnace through the interspace between the roof and the side wall of the furnace due to the depression created by the intake systems, from coming into contact with the electrodes, causing problems of oxidation and therefore of premature wear; also, to prevent the atmospheric air from causing oxidation reactions with metallic elements in the molten state present in the layer of slag and the liquid bath, thus causing a deterioration in the quality of the steel produced.

Another purpose is to provide a roof which will make it possible to obtain an optimum heat insulation and improved productivity of the furnace, with a consequent reduction in the management costs.

A further purpose of the invention is to reduce the risks of breakages to the cooling conduits, thus increasing the working life of the roof and reducing downtimes for maintenance.

Another purpose is to obtain a cooling structure which can easily be installed and manipulated for maintenance and intervention operations.

A further purpose is to reduce the speed at which the fumes are discharged so as to diminish the capacity of the fumes to carry away the fine elements which are suspended inside the melting volume, thus efficiently separating the powders and volatile slag from the gassy current and ensuring a greater yield of the melting materials.

The cooled roof according to the invention comprises two single-block structures consisting of cooling tubes, an outer structure and an inner structure; the two structures are associated at least in correspondence with the base and are separated by an annular interspace inside which there is an annular circulation of the fumes inspired through the discharge aperture.

The annular interspace is connected with the intake systems provided to discharge the fumes from the furnace.

The interspace encourages the distribution of the fumes over the whole inner surface of the roof and therefore makes the depression caused by the peripheral inspiration uniform and homogeneous.

Moreover, by increasing the inspiration section, the speed of the fumes is drastically reduced, particularly in the zone above the melting bath; this causes the fumes to cause less turbulence within the atmosphere of the melting volume.

According to one embodiment of the invention, each single-block structure which constitutes the roof according to the invention can be individually removed and is achieved with tubes, bent during the production step to substantially assume a shape like rings or superimposed spirals, inside which a cooling liquid, normally water, is made to circulate under pressure.

The welds needed to join the tubes, which are limited in number due to the tubes being already bent, are limited to the zones of the melting volume which are not subject to great thermal/mechanical stresses.

According to a variant, the inner and outer single-block structures are substantially coaxial.

In the preferred embodiment of the invention, the outer single-block structure has a substantially cylindrical conformation, substantially defining the conformation of the roof, and contains the inner single-block structure, which has a conformation substantially like a truncated cone tapering upwards.

The inner single-block structure conformed like a truncated cone has a substantially central aperture through which the electrodes pass and are inserted.

In one embodiment of the invention, the inner single-block structure has a lower diameter, or base diameter, of between 0.8 and 0.95 of the inner diameter of the outer single-block structure, and an upper diameter of between 0.55 and 0.70 of the said inner diameter.

The interaxis between the spirals of the tubes of the inner, truncated-cone structure is equal to 1.1÷1.4 times the interaxis between the spirals of the tubes of the outer, cylindrical structure.

This configuration defines a reticular structure with adjacent tubes which achieves a grid effect for the controlled passage of the fumes, from the melting volume to the annular circulation chamber defined between the inner and outer structures, with the flow consequently being made uniform and homogeneous.

Moreover, the atmospheric air entering from outside into the furnace is forced to circulate in the said annular chamber defined between the external and internal structure, and therefore does not come into contact with the electrodes which are thus protected by the inner, truncated-cone structure.

According to a variant, at least the outer, cylindrical structure is internally lined with a layer of refractory material which has a protective function.

According to the invention, by using two single-block cooling structures which are autonomous and individually removable, it is possible to replace one structure at a time as a consequence of, for example, damage or wear.

In the preferred embodiment of the invention, the inner truncated-cone structure has a desired pitch between the super-imposed rings: this may be constant for the whole vertical development of the rings or, according to a variant, it may be variable.

According to the invention, the density of the rings may be varied at will during the design step, to obtain a greater or lesser cooling effect on a particular zone according to requirements.

According to one embodiment of the invention, the density of the rings varies in a uniform manner from a maximum to a minimum point.

According to a variant, the point of maximum density of the rings occurs at the zone of the aperture through which the fumes are discharged, which is the hottest zone of the roof; the point of minimum density of the rings coincides with the coolest point of the roof, which is substantially situated in a position diametrically opposite the position of the discharge aperture.

This differentiated distribution of the spirals allows the roof to be cooled in a differentiated manner; this makes it possible to considerably improve the productivity of the furnace and to distribute the wear of the roof in a uniform manner.

According to the invention, moreover, the conformation of the two cooling structures, or their distance, can be varied in a desired manner so as to vary the volume and/or the conformation of the interspace and therefore the delivery; this will allow, for example, a more uniform distribution of the inspiration of the fumes in the volume of the furnace and on the surface of the roof.

According to a variant, in addition to the afore-mentioned inner and outer cooling structures, there is a third cooling structure, also single-block and with an independent cooling system, associated with the electrode-bearing cover.

This embodiment makes it possible to cool the central zone of the roof more efficaciously, to obtain a longer working life for the electrodes and the relative cover and a greater mechanical resistance which will last in time.

According to the invention the inner cooling structure, shaped like a truncated cone, functions as an element to distribute, slow down and stabilise the fumes.

In fact, the fumes passing between the interstices between the super-imposed rings of the inner cooling structure are distributed in a uniform manner over the whole volume of the annular interspace and reach the discharge aperture with a reduced speed and turbulence.

The uniform distribution of the fumes and their reduced speed and turbulence make it possible to use less powerful inspiration systems associated with the discharge aperture; this makes it possible to reduce energy consumption but above all to avoid excessive infiltrations of air inside the furnace through the roof/furnace coupling surfaces.

Above all, the air which enters peripherally into the melting volume is directly inspired into the interspace created between the two single-block elements which constitute the roof, thus preventing the air from mixing with the processing fumes in the melting volume and passing into zones near the lateral surface of the electrodes.

Moreover, the oxidising effect of the bath is reduced and the controlled atmosphere above the bath is altered. With the roof according to the invention, it is therefore possible to obtain greater heat and energy yields and to reduce wear due to oxidation of the electrodes.

Moreover, with the roof according to the invention, the flow of fumes to be discharged is propagated prevalently in correspondence with the perimeter part of the furnace, which makes it possible to prevent the fumes from lapping and wearing the electrodes.

According to a variant of the invention, the outer, cylindrical cooling structure has a lower segment inclined inwards and suitable to cooperate with a top segment of the wall of the furnace which is also inclined, downwards with respect to the horizontal, in order to define a thin fissure which runs around the circumference of the furnace in correspondence with the interstice between the roof and the side wall.

This fissure cooperates with an outer lining suitable to create a transit channel, shaped like a Venturi tube, for the atmospheric air.

The presence of the inclined fissure, together with the shape of the transit channel, prevents the atmospheric air from reaching the layer of slag above the liquid bath, and therefore prevents the generation of oxidation reactions which lower the quality of the liquid steel.

According to the invention, moreover, thanks to the slow-down in the speed of the discharge fumes enacted by the inner cooling structure, it is possible to abate inside the furnace a large quantity of powder, particles and slag suspended in the fumes before the latter reach, through the discharge aperture, the filter systems cooperating with the inspiration means associated with the discharge aperture.

Therefore, the invention also makes the action of the filter systems more efficacious and extends their working life.

With the invention, the slag suspended in the fumes attaches itself in an extremely short time to the rings of the inner cooling structure, achieving a layer of continuous insulation on the outer surface of the conduit.

According to a variant, on the conduits of the cooling structures there are gripping and anchoring elements, for example plate-shaped, which encourage the suspended slag to deposit. The innermost part of the super-imposed rings is also covered by slag so as to form an insulating layer, but the continuous flow of the fumes inspired through the discharge aperture prevents the slits between two adjacent rings from closing completely, thus ensuring the free passage of the fumes.

According to a variant, in order to render each cooling structure self-supporting, the cooling conduits are reinforced and supported by the appropriate supporting elements.

According to another variant, the discharge aperture is associated with an elbow-shaped discharge conduit equipped with its own autonomous single-block cooling structure consisting of at least a conduit wound in spirals which are separated from each other.

In the preferential embodiment, the elbow-shaped discharge conduit has a metallic body which covers the tube, with the exception of a desired portion of the lower part which is associated with the outer cooling structure.

BRIEF DESCRIPTION OF THE DRAWINGS

The attached Figures are given as a non-restrictive example and show some preferential embodiments of the invention as follows.

DETAILED DESCRIPTION OF PREFERRED EMBODIMENT

Figure 1:
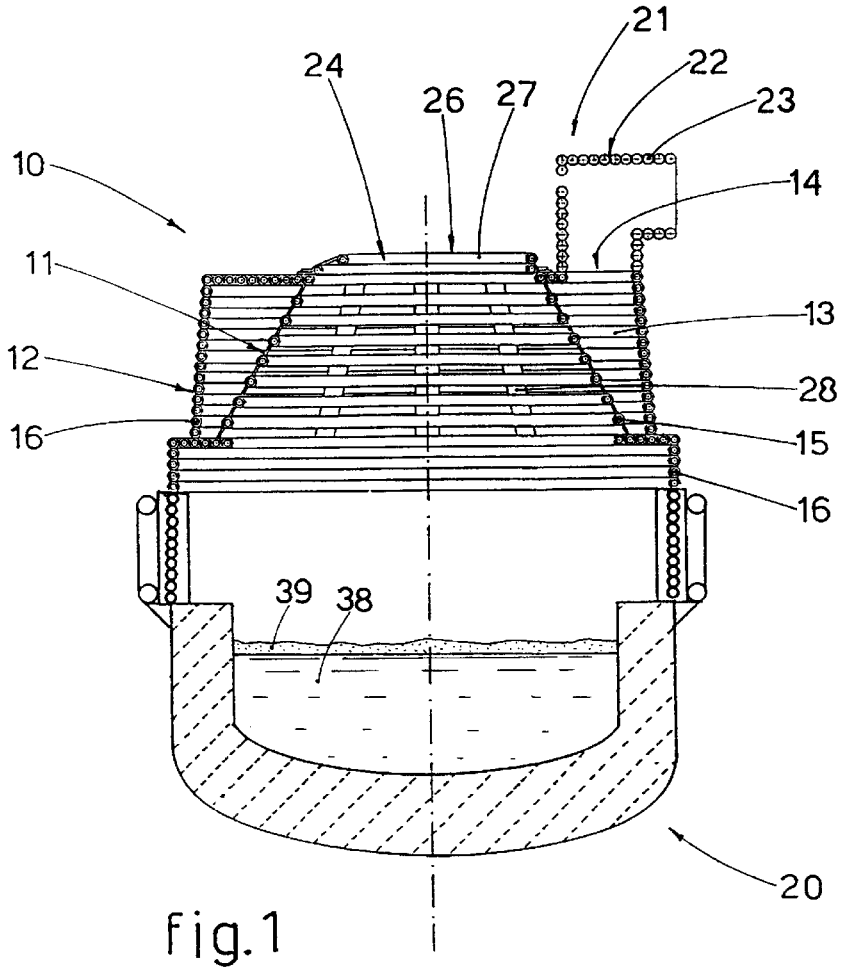
FIG. 1 shows a lengthwise cross-section of a cooled roof according to the invention associated with an electric arc furnace.

The cooled roof 10 according to the invention shown in FIG. 1 is associated with an electric arc furnace 20, shown only in diagram form and without the electrodes, for the sake of simplicity.

Figure 6:
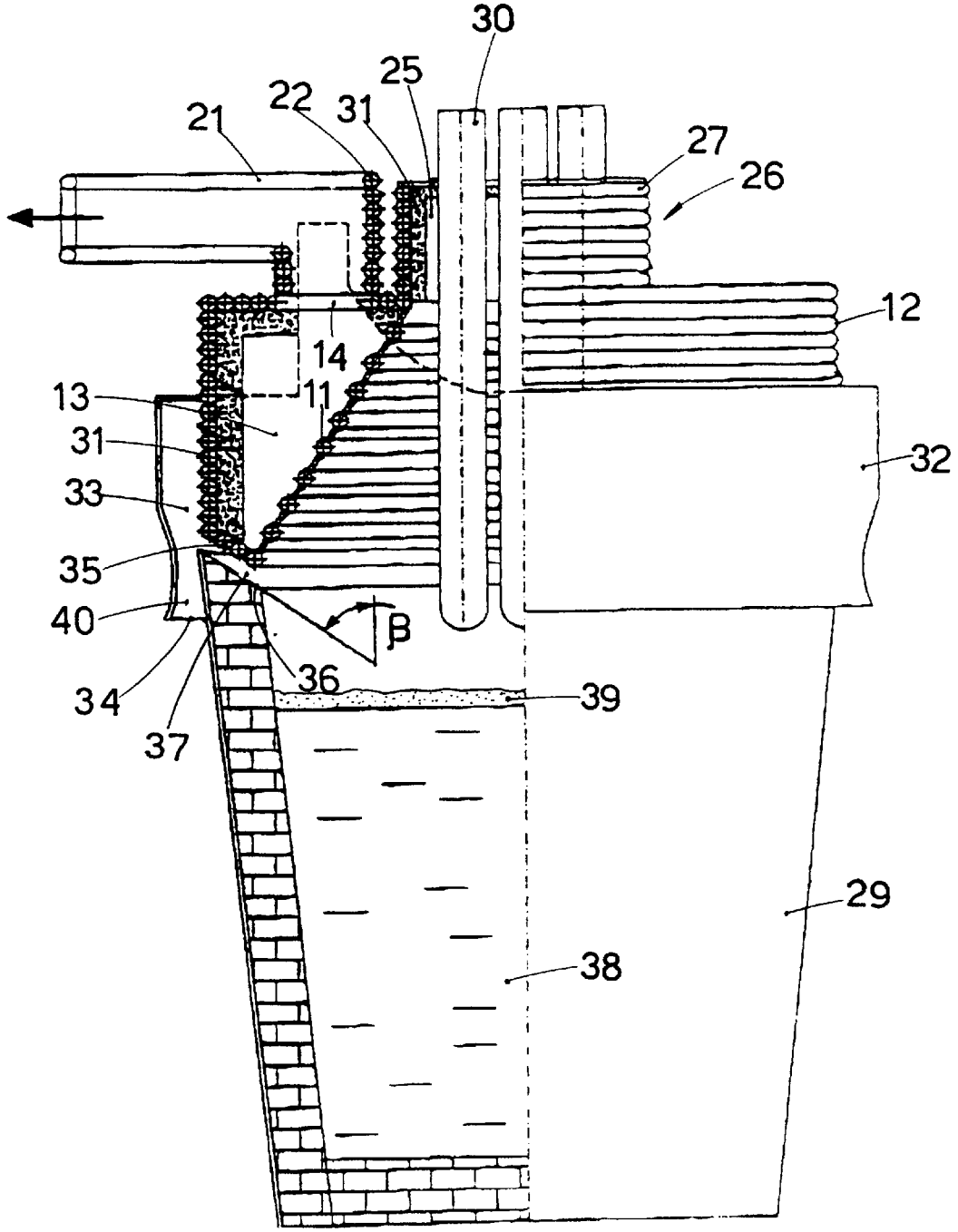
FIG. 6 shows a variant of FIG. 1 in a half-seen half-section, applied in the case of a ladle furnace.

The variant shown in FIG. 6 shows the roof 10 applied to a ladle furnace 29 equipped with three electrodes 30.

Inside the furnace 20, 29 a liquid bath 38 is formed, covered by a layer of slag 39.

Figure 2:
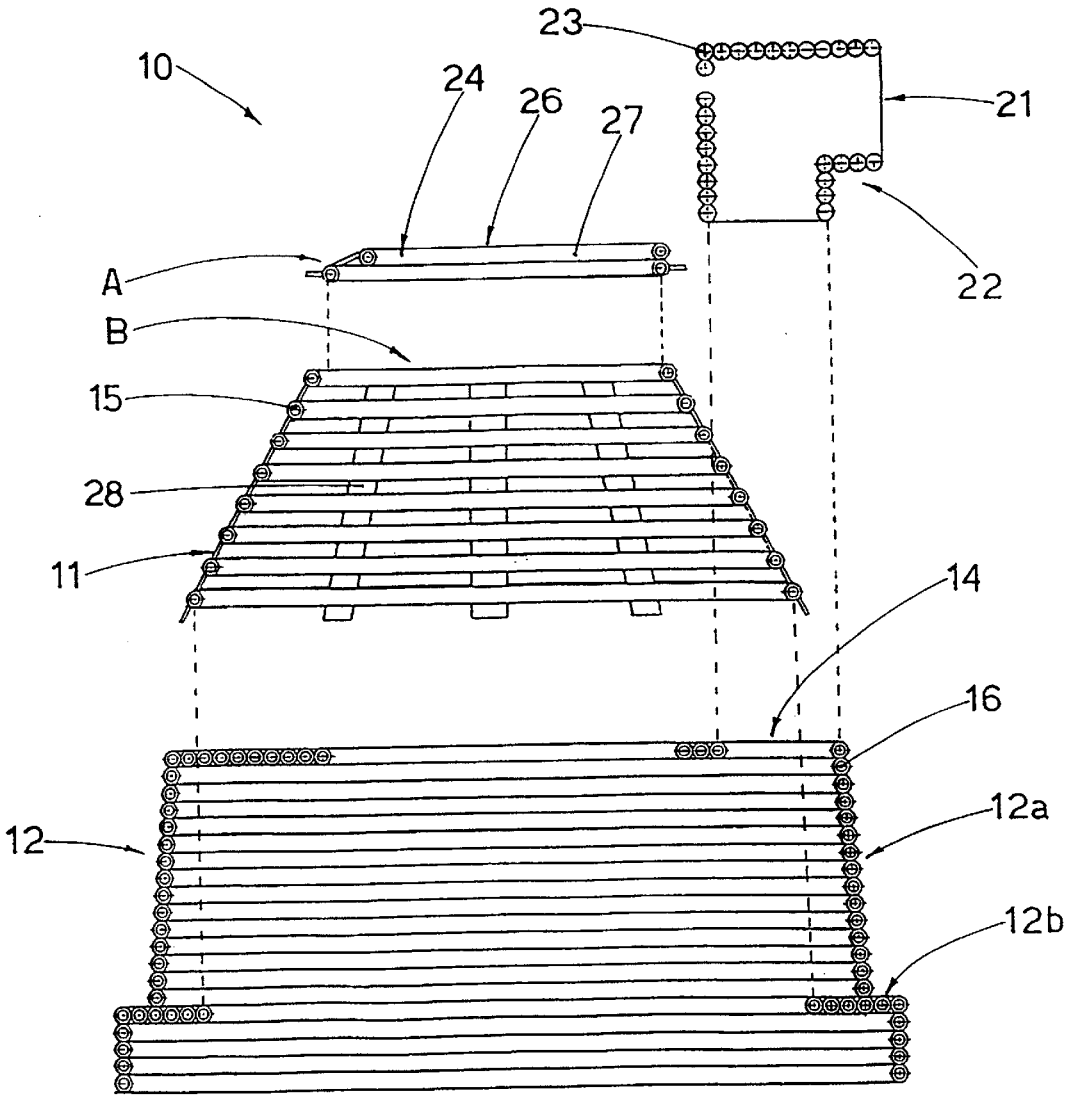
FIG. 2 shows a partly exploded view of FIG. 1.

As shown in detail in FIG. 2, the cooled roof 10 consists of two reciprocally autonomous single-block cooling structures, respectively inner cooling structure 11 and outer cooling structure 12, in this case coaxial to each other and to the electric arc furnace 20.

The cooling structures 11 and 12 consist of bent tubes, respectively 15 and 16, shaped like a ring or spiral and arranged very close together, wherein a cooling fluid is made to circulate under pressure.

The outer cooling structure 12 is cylindrical in shape and defines substantially the conformation of the cooled roof 10.

In the variant shown in FIG. 6, the outer cooling structure 12 is lined on the inside with a layer of refractory material 31 which has the function of protecting the said outer cooling structure 12 from over-heating and any possible mechanical impacts.

According to the invention, when the inner cooling structure 11 and outer cooling structure 12 are associated, in this case in correspondence with their respective bases, they define inside the roof 10 an annular interspace 13 (FIG. 1) into which the fumes generated in the furnace 20, 29 during the melting cycles flow, as will be described in more detail hereinafter.

According to the invention, the annular interspace 13 functions as a chamber to inspire and circulate the fumes and cooperates at the upper part with a discharge aperture 14, or fourth hole, made on the outer cooling structure 12.

The aperture 14 is associated at the upper part with an elbow-shaped conduit 21 associated with inspiration means which are not shown here.

According to the invention, the elbow-shaped conduit 21 has its own cooling structure 22 defined by a continuous helical-shaped bent tube 23 with spirals which are distanced so as to define interstices through which the fumes pass.

The interstices make it possible both to increase the surfaces of heat exchange of the cooling structure 22; they also allow the volatile slag to deposit so as to form an insulating layer able to retain the heat and to protect the tube 23.

In this case, the inner cooling structure 11 has the conformation of a truncated cone with the larger base facing downwards while the outer cooling structure 12 has a cylindrical conformation which contains inside the inner cooling structure 11.

In this case, the base diameter of the inner structure 11 is equal to about 0.8 to 0.95 of the diameter of the outer structure 12, which coincides with the inner diameter of the roof 10, while the upper diameter of the structure 11 is equal to about 0.55 to 0.70 of the diameter of the outer structure 12.

In the embodiment shown here, the inner cooling structure 11 comprises longitudinal supporting elements 28 which give the bent tube 15 the desired rigidity, rendering the structure 11 self-supporting.

In the embodiment shown in FIG. 1, the outer cooling structure 12 has a lower part **12*b* with a cylindrical conformation, which has a supporting function and a diameter substantially mating with the diameter of the furnace 20, and an upper part 12*a*** which has the conformation of a slightly truncated cone.

According to a variant, the upper part **12*a* is cylindrical and its diameter is less than that of the lower part 12*b***.

According to another variant, the upper part **12*a*** is cap-shaped.

According to the invention, the outer cooling structure 12 consists of bent tubes 16 wound into super-imposed rings, located in contact with each other; the inner cooling structure 11 consists of bent tubes 15 wound into super-imposed rings but these are slightly distanced from each other so as to define a reticular or grid-type structure including interstices with a variable pitch between adjacent rings.

To be more exact, according to the invention, the interaxis between the tubes 15 of the inner structure 11 is between about 1.1 and 1.4 times the interaxis between the tubes 16 of the outer structure 12.

Figure 5:
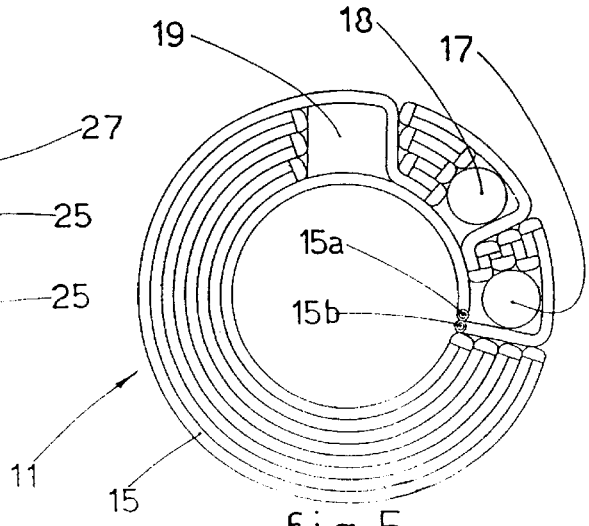
FIG. 5 shows an enlarged view from above of the detail "B" of FIG. 2.

In this case, as shown in FIG. 5, the bent tubes 15 defining the inner cooling structure 11 have one inlet **15*a* only and one outlet 15*b* only and a coiled development suitable to define three apertures respectively 17, 18 and 19** used, for example, to associate alternative sources such as lances, burners, etc. and/or to feed solid, liquid or gassy additives.

According to the invention, the fumes generated inside the furnace 20 during the melting cycles pass though the interstices present between the super-imposed rings of the bent tubes 15 of the inner cooling structure 11 and reach the annular interspace 13 in which a depression is created by the afore-said inspiration means.

The inner cooling structure 11, not only causes a first lowering of the temperature of the fumes, but also functions as an element to distribute the fumes, reducing their speed and turbulence.

The reticular structure of the inner cooling structure 11 acts as a distribution grid which graduates the passage of the fumes in a uniform manner over the whole volume of the interspace 13 in such a way as to balance and encourage the heat exchange with the cooled roof 10.

Moreover, the solid and semi-solid parts, such as powders, slag or particles, dispersed in the current of gas which rises from the liquid bath 38, are partly retained by the tubes 15 of the grid structure and made to fall back inside the liquid bath 38.

The reduction in speed and turbulence, as well as the uniform distribution, of the fumes inside the annular interspace 13 makes it possible to have lower energy consumption and fewer infiltrations of atmospheric air inside the furnace 20.

According to a variant, the density of the rings of the bent tubes 15 is variable, thus allowing a greater cooling of the hottest points of the roof 10; the differentiated cooling of the roof 10 and the distributed inspiration of the discharge fumes make it possible to considerably improve the productivity of the furnace 20, with a considerable reduction of the operating costs.

According to the invention, moreover, the volatile slag in the discharge fumes which enter the interspace 13 through the interstices between the super-imposed rings of the bent tubes 15 cause a lining layer to be formed which anchors itself to the tubes 15 and acts as an insulating agent able to retain the heat of the fumes and to protect the tubes 15.

Figure 4:
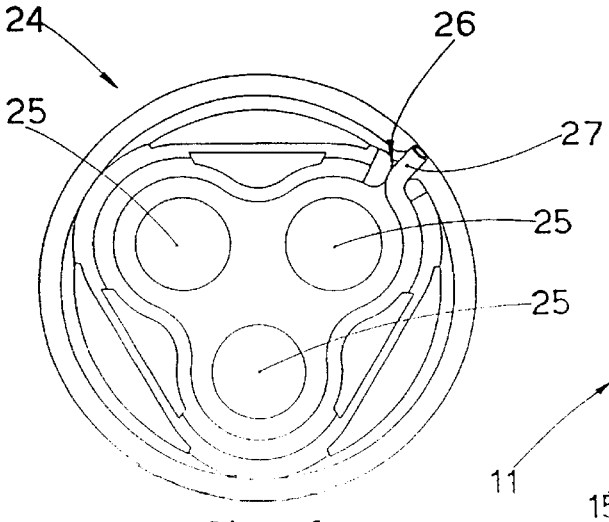
FIG. 4 shows an enlarged view from above of the detail "A" of FIG. 2.

In the central part of the roof 10 there is a cover 24 equipped at the center with three holes 25 through which the electrodes are inserted (FIG. 4).

According to the invention, the cover 24 has its own cooling structure 26 defined by single-block tubes 27 bent during the production step to assume a conformation of adjacent and super-imposed rings.

Figure 3:
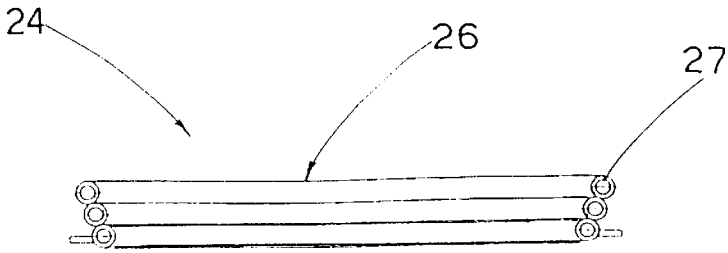
FIG. 3 shows a part view of a variant of the detail "A" in FIG. 2.

In the embodiment shown in FIGS. 1 and 2 the tubes 27 define two rings; the upper ring has a smaller diameter while in the variant shown in FIG. 3 the tubes 27 define three rings with a diameter which increases upwards.

According to a variant shown in FIG. 6, the tubes 27 are lined towards the inside of the melting volume by a layer of refractory material 31.

In this embodiment, the cooling structure 26 which acts as a cover has a cylindrical shape with a diameter which is slightly more than the circumference which circumscribes the three electrodes 30.

The fumes which rise from the melting volume are not sucked in through the holes 25 though which the electrodes 30 are introduced, thanks to the depression created in the annular interspace 13 by the intake system connected to the conduit 21.

In this way the wear deriving from the oxidation of the electrodes 30 is reduced.

The holes 25 for the electrodes are arranged at a minimal distance from the cooled tubes in order to prevent short circuits and the generation of discharges.

In the embodiment shown in FIG. 6, around the lower part of the outer cooling structure 12 there is an outer casing 32 which covers the circumference of the upper part of the furnace 29. With the outer wall of the structure 12, the outer casing 32 defines a chamber 33 connected with the outside environment by means of the lower circumferential fissure 34.

The lower part of the outer casing 32 has a recess towards the outer wall of the structure 12 so as to define, together with the fissure 34, a channel through which air can enter, which is shaped like Venturi tube.

In correspondence with its lower edge, the outer structure 12 has a circumferential segment 35 inclined inwards with respect to the vertical.

In co-operation with a mating segment 36 made at the top of the wall of the furnace 29, also inclined with respect to the vertical, the segment 35 defines a fissure 37 which lets the chamber 33 communicate with the inside of the melting volume.

In this case, the two segments 35 and 36 are parallel to each other and define an angle β with respect to the vertical of between 30 and 50°.

The influx of atmospheric air entering the chamber 33 through the circumferential fissure 34 cannot reach the layer of slag 39 and/or the liquid bath 38 thanks to the simultaneous presence of the Venturi tube channel 40 and the inclined fissure 37, which balance the negative pressure which is created in the interspace 13 due to the action of the intake systems.

This combination guarantees in any case a certain influx of atmospheric air which is mixed inside the interspace 13 with the discharge fumes sucked in by the melting volume, causing an advantageous lowering of the temperature of the said fumes before they are discharged through the cooled conduit 21.

What is claimed is:

1. A cooled roof for an electric arc furnace (20) or a ladle furnace (29), the furnace comprising an inside, the roof being usable as a covering element and comprising:

a cooling system comprising tubes fed with cooling fluid, at least one central aperture (25) for the positioning and movement of electrodes (30) and at least a peripheral aperture (14) for the aspiration and discharge of fumes, the peripheral aperture (14) for being connected with intake systems, an inner single block cooling structure (11) and an outer single block cooling structure (12), each cooling structure comprising respective bent tubes (15, 16) developing according to adjacent and super-imposed rings or spirals, the inner cooling structure (11) and the outer cooling structure (12) having respective bases and being associated with one another at least in correspondence with the respective bases facing towards the inside of the furnace (20, 29), between the inner cooling structure (11) and the outer cooling structure (12) there being an annular interspace (13) for circulating the fumes in an annular direction and slowing down the fumes, the annular interspace (13) communicating with the peripheral aperture (14), the inner cooling structure (11) comprising fume-transit interstices connecting the inside of the furnace (20, 29) with the annular interspace (13).

2. The cooled roof as in claim 1, wherein the outer cooling structure (12) has a substantially cylindrical shape defining the outer shape of the roof (10) and the inner cooling structure (11) has a truncated cone conformation, a larger base of the truncated cone conformation facing downwards being the base of the inner cooling structure, contained inside the outer structure (12).

3. The cooled roof as in claim 1, wherein the inner structure (11) is arranged coaxial to the outer structure (12).

4. The cooled roof as in claim 3, wherein the inner structure (11) has a lower or base diameter of between 0.8 and 0.95 times the inner diameter of the outer structure (12), and an upper diameter of between 0.55 and 0.70 times the inner diameter of the structure (12).

5. The cooled roof as in claim 1, wherein the inner cooling structure (11) comprises ready-bent tubes (15) weldless at the critical points of thermo-mechanical stress and arranged in rings or concentric spirals defining interstices for the fumes to pass through.

6. The cooled roof as in claim 1, wherein the outer cooling structure (12) comprises bent tubes (16) weldless at the critical points of great thermo-mechanical stress and arranged in rings or concentric spirals in close contact with each other.

7. The cooled roof as in claim 5, wherein the pitch of the spirals defined by the tubes (15) of the inner structure (11) is 1.1 to 1.4 times the pitch of the spirals defined by the tubes (16) of the outer structure (12).

8. The cooled roof as in claim 1, wherein the density of the rings of the bent tubes (15, 16) of the inner cooling structure (11) and/or of the outer cooling structure (12) is variable along the circumference of the roof (10).

9. The cooled roof as in claim 8, wherein the density of the rings of the bent tubes (15, 16) is at a maximum in correspondence with the aperture (14) to discharge the fumes.

10. The cooled roof as in claim 1, wherein the outer cooling structure (12) is lined on the inside with a layer of refractory material (31).

11. The cooled roof as in claim 1, wherein the outer cooling structure (12), at least in its lower part, is outwardly associated with a lining (32) defining, with the outside wall of the structure (12), a chamber (33) communicating with the outside environment through a circumferential fissure (34) for the influx of atmospheric air.

12. The cooled roof as in claim 11, wherein the circumferential fissure (34) defines a venturi-shaped channel (40) through which atmospheric air can pass.

13. The cooled roof as in claim 12, wherein the chamber (33) is connected with the inside of the furnace through a fissure (37) made between the lower edge of the outer structure (12) and the top of the side wall of the furnace (20, 29).

14. The cooled roof as in claim 13, wherein the fissure (37) is inclined downwards with respect to the vertical by an angle of (β).

15. The cooled roof as in claim 14, wherein the angle (β) is between and 30° and 50°.

16. The cooled roof as in claim 1, wherein the bent tubes (15, 16) of the respective inner cooling structure (11) and outer cooling structure (12) each have an inlet and an outlet for the cooling fluid.

17. The cooled roof as in claim 16, wherein the ends of the bent tubes (15, 16) are joined at a joint to form a substantially continuous tube.

18. The cooled roof as in claim 17, wherein the joint is made along the outer periphery of the roof (10).

19. The cooled roof as in claim 1, wherein an upper part of the discharge aperture (14) is associated with an elbow-shaped discharge conduit (21), the elbow-shaped discharge conduit (21) comprising a cooling structure (22) comprising a helical-shaped tube (23) with spirals which are distanced to define interstices for passing fumes therethrough and depositing slag thereon.

20. The cooled roof as in claim 1, wherein the inner cooling structure (11) and outer cooling structure (12) are individually removable.

21. The cooled roof as in claim 1, comprising at the at least one central aperature (25) a closing and electrode-supporting element (24) defined by ready-bent tubes (27) in concentric rings defining the at least one central aperature (25) for inserting the electrodes.

22. The cooled roof as in claim 21, wherein the tubes (27) of the closing element (24) are fed with an independent cooling system.

23. The cooled roof as in claim 21, wherein the closing element (24) has an inner part lined with refractory material (31).

* * * * *